US009915897B2

(12) United States Patent
Narahara et al.

(10) Patent No.: US 9,915,897 B2
(45) Date of Patent: Mar. 13, 2018

(54) FIXING DEVICE

(71) Applicant: CANON KABUSHIKI KAISHA, Tokyo (JP)

(72) Inventors: Takashi Narahara, Mishima (JP); Takeshi Shinji, Yokohama (JP); Toru Imaizumi, Kawasaki (JP); Kazuhiro Doda, Yokohama (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/252,367

(22) Filed: Aug. 31, 2016

(65) Prior Publication Data

US 2017/0060052 A1 Mar. 2, 2017

(30) Foreign Application Priority Data

Sep. 1, 2015 (JP) ..... 2015-171833

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC combination set(s) only.
See application file for complete search history.

(56) References Cited

U.S. PATENT DOCUMENTS

| | | | |
|---|---|---|---|
| 7,389,079 | B2 | 6/2008 | Narahara et al. |
| 8,331,819 | B2 | 12/2012 | Fukuzawa et al. |
| 8,744,296 | B2 | 6/2014 | Fukuzawa et al. |
| 8,971,744 | B2 | 3/2015 | Nihonyanagi et al. |

(Continued)

FOREIGN PATENT DOCUMENTS

| | | |
|---|---|---|
| EP | 1879080 A1 | 1/2008 |
| JP | 04-172482 A | 6/1992 |

(Continued)

OTHER PUBLICATIONS

Copending unpublished U.S. Appl. No. 15/215,734, filed Jul. 21, 2016 to Karen Tsunashima et al.

(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A fixing device includes a heating member including a base layer, first and second electroconductive layers and a plurality of heat generating resistors provided on the base layer and having a volume resistivity smaller than a volume resistivity of the base layer; a temperature detecting member; and an electrode member. The heat generating resistors are provided helically around the base layer so that a helical axis thereof extends along the longitudinal direction of the rotatable member, and are disposed with intervals. One end and the other end of each of the heat generating resistors are electrically connected with the first and the second electroconductive layers, respectively. A temperature detecting region of the rotatable member by the temperature detecting member overlaps with the heat generating resistors.

9 Claims, 13 Drawing Sheets

(56) References Cited

U.S. PATENT DOCUMENTS

| | | | | |
|---|---|---|---|---|
| 9,182,713 | B2 | 11/2015 | Narahara et al. | |
| 9,229,388 | B2 | 1/2016 | Imaizumi et al. | |
| 9,235,172 | B2 | 1/2016 | Imaizumi et al. | |
| 9,417,576 | B2 | 8/2016 | Minamishima et al. | |
| 9,423,737 | B2 | 8/2016 | Narahara et al. | |
| 2007/0009292 | A1 | 1/2007 | Kim et al. | |
| 2008/0013994 | A1 | 1/2008 | Lee et al. | |
| 2013/0243463 | A1* | 9/2013 | Kanai | G03G 15/2039 399/67 |
| 2014/0023413 | A1 | 1/2014 | Shinji et al. | |
| 2015/0227091 | A1 | 8/2015 | Ando et al. | |
| 2016/0085191 | A1 | 3/2016 | Imaizumi et al. | |
| 2016/0139551 | A1 | 5/2016 | Nurahara et al. | |

FOREIGN PATENT DOCUMENTS

| | | | | | |
|---|---|---|---|---|---|
| JP | 07-92839 | A | | 4/1995 | |
| JP | 2008112047 | A | * | 5/2008 | G03G 15/20 |
| JP | 2008112047 | A | | 5/2008 | |
| JP | 2008287025 | A | | 11/2008 | |
| JP | 2012-022042 | A | | 2/2012 | |
| JP | 2013-097315 | A | | 5/2013 | |

OTHER PUBLICATIONS

U.S. Appl. No. 15/215,734, filed Jul. 21, 2016.
Search Report issued in corresponding European Patent Application No. 16184285.1 dated Dec. 19, 2016.

* cited by examiner (a)

(b)

FIXING DEVICE

FIELD OF THE INVENTION AND RELATED ART

The present invention relates to a fixing device using a cylindrical rotatable member (rotatable heating member) and is suitable for the fixing device for use with an image forming apparatus such as a printer or a copying machine.

As the fixing device for the image forming apparatus such as the printer or the copying machine, a fixing device in which electric power is supplied to a rotatable heating member such as a roller including an electroconductive layer to cause Joule heating (heat generation) and thus high-speed rising and energy saving are realized is used. Specifically, Japanese Laid-Open Patent Application 2013-97315 discloses a fixing member including a heat generating resistor layer in which a carbon filler is dispersed in a heat-resistant resin material and which includes an insulating elastic layer and a parting layer, which are coated on the heat generating resistor layer. In this fixing device, heat is generated by directly supplying electric power to the heat generating resistor layer which is a part of the rotatable heating member, and therefore, a warm-up time can be shortened.

However, strength of the insulating layers including the elastic layer and the parting layer is not sufficient, and therefore, there is a possibility that the insulating layers are damaged by friction (sliding) with a foreign matter which enters the fixing device from an outside or with a recording material and then the damage has the influence on the heat generating resistor layer. Further, due to jam clearance by a user or the like, there is a possibility that the heat generating resistor layer is damaged with tweezers or a cutter. In such a case, a current density locally increases at a periphery of an end portion of the damaged portion, so that there is a possibility that abnormal heat generation occurs at the end portion.

FIG. 18 is a schematic view showing a state in which in a fixing device using a fixing member including a conventional heat generating resistor layer, when a crack C generates in the heat generating resistor layer, a current flowing in the heat generating resistor layer concentrates at a neighborhood of an end portion of the crack C. Around both end portions of a fixing film 1 as the rotatable heating member with respect to a longitudinal direction of the fixing film 1, electroconductive layers 1*b* are provided, and electric power supplying members 3*a* and 3*b* for energization are contacted to the electroconductive layers 1*b*, so that the energization is made by an AC voltage source 50 and thus the fixing film 1 is caused to generate heat.

A pressing roller 4 is rotationally driven and opposes the fixing film 1, so that a nip (energization) is formed by the pressing roller 4 in cooperation with the fixing film 1. Further, currents I1-I4 flow into the heat generating resistor layer at a point of time. By providing the electroconductive layers 1*b*, the current uniformly flows in a longitudinal direction in the heat generating resistor layer of the fixing film 1, so that heat can be generated uniformly.

However, when the crack C generates in the heat generating resistor layer, traveling (movement) of the currents I2 and I3 is blocked, so that the currents I2 and I3 flow along peripheries of end portions of the crack C. Therefore, in each of regions A and B at the peripheries of the end portions, the current concentrates and thus, the current density increases, so that abnormal heat generation locally occurs in the portion corresponding to the regions A and B. At the portion where the abnormal heat generation occurs, a temperature remarkably increases compared with a normal portion, and therefore, the fixing film 1 is thermally damaged and an image defect is caused in some cases.

In order to prevent the abnormal heat generation during the generation of the crack C, as shown in FIG. 19, it would be considered that a constitution in which a plurality of heat generating resistors, obtained by division of the heat generating resistor layer along a circumferential direction, are formed, and the current density does not concentrate partly even when the crack C generates along the circumferential direction, is employed. In FIG. 19, heat generating resistors 1*e* are formed on an insulating base layer 1*a*.

However, in the constitution shown in FIG. 19, a new problem such that it becomes difficult to detect a temperature in a rotation stop state during the generation of the crack generates. This is because in the case where the heat generating resistor is interrupted (broken) by the crack along the circumferential direction, heat does not generate in an entire longitudinal region in which the broken heat generating resistor is formed, and in this region, toner detection by a temperature detecting element provided in the longitudinal region cannot be made. On the other hand, at a portion where the crack does not generate, toner increases and therefore abnormal high temperature in the rotation stop state cannot be immediately detected. This will be specifically described with reference to FIG. 20.

FIG. 20 shows a state in which the crack C generated in the fixing film having the constitution shown in FIG. 19 in which the plurality of heat generating resistors were formed. A solid gray region is a region in which the heat generating resistors are interrupted (broken) by the crack C, and thus, heat does not generate even when energization is made. Accordingly, in the case where a temperature detecting element is provided in a longitudinal region at a portion where the crack C generated, a temperature rise cannot be detected.

SUMMARY OF THE INVENTION

According to an aspect of the present invention, there is provided a fixing device for fixing an image on a recording material, comprising: a rotatable heating member for heating the image, wherein the rotatable heating member comprises, a base layer, first and second electroconductive layers provided at end portions, respectively, of the base layer with respect to a longitudinal direction of the rotatable heating member, and a plurality of heat generating resistors provided on the base layer and having a volume resistivity smaller than a volume resistivity of the base layer; a temperature detecting member for detecting a temperature of the rotatable heating member; and an electrode member, contacting the first electroconductive layer and the second electroconductive layer, for supplying electric power to the heat generating resistors, wherein the heat generating resistors are provided helically around the base layer so that a helical axis thereof extends along the longitudinal direction of the rotatable member, and are disposed with intervals, wherein one end and the other end of each of the heat generating resistors are electrically connected with the first and second electroconductive layers, respectively, and wherein a temperature detecting region of the rotatable heating member by the temperature detecting member overlaps with the heat generating resistors.

Further features of the present invention will become apparent from the following description of exemplary embodiments with reference to the attached drawings.

DESCRIPTION OF THE EMBODIMENTS

A rotatable heating member (cylindrical rotatable member) according to the present invention and a fixing device using the rotatable heating member will be specifically described. In the following description of the rotatable heating member and the fixing device, a longitudinal direction refers to a generatrix direction of a cylindrical shape of a surface of the rotatable heating member. Further, a circumferential direction refers to a direction of a circumference of a circle of the cylindrical shape of the surface of the rotatable heating member. Further, a thickness direction refers to a radial direction of the cylindrical shape of the surface of the rotatable heating member.

First Embodiment (Fixing Device)

Figure 5:
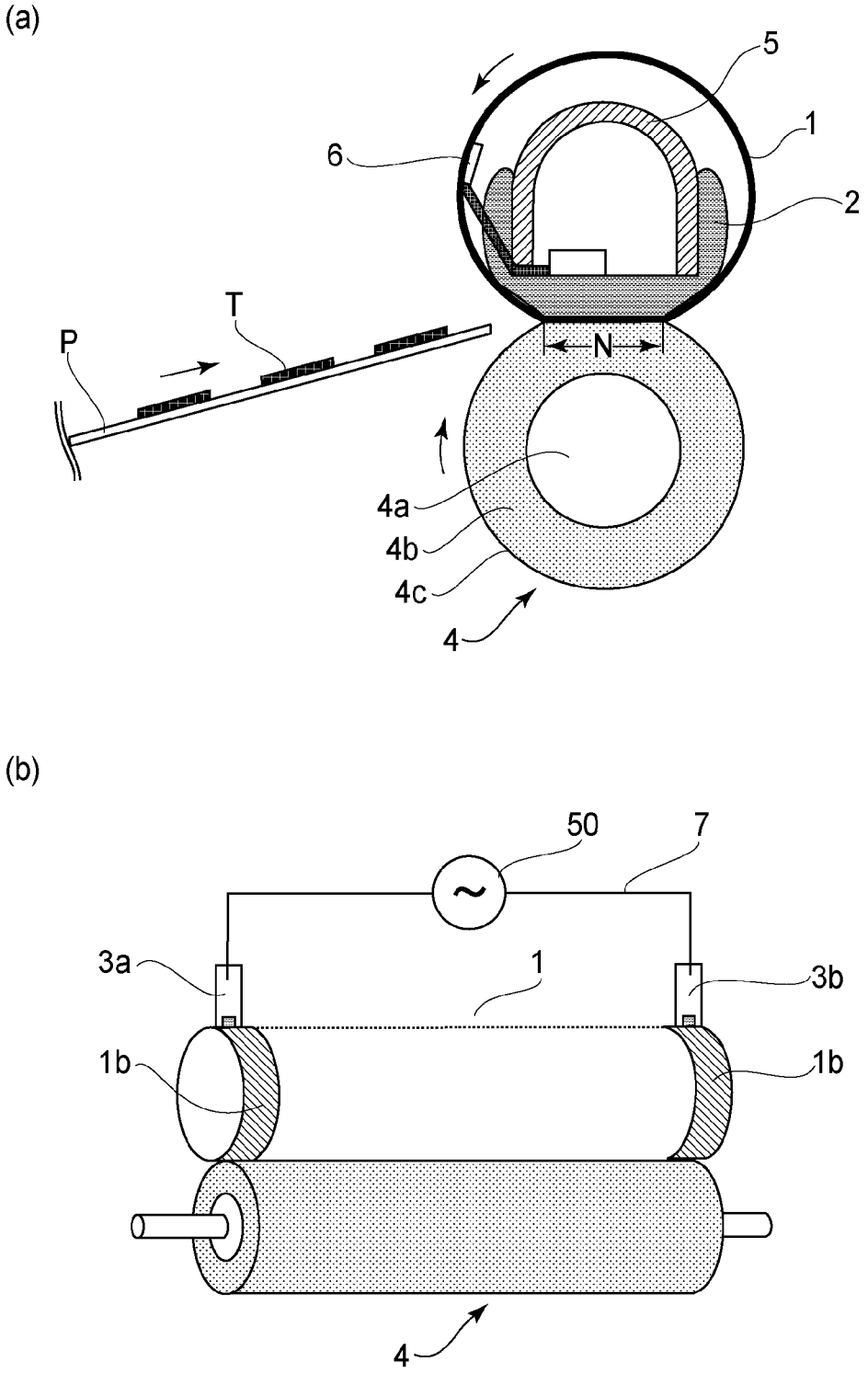
In FIG. 5, (a) is a schematic view of a fixing device in the First Embodiment, and (b) is a perspective view of the fixing device as seen in a recording material feeding direction in the First Embodiment.

A fixing device using a rotatable heating member according to a First Embodiment of the present invention will be described using FIG. 5. In FIG. 5, (a) is a schematic sectional view of the fixing device at a longitudinal central portion, and (b) is a schematic view of the fixing device as seen in a recording material feeding direction crossing the longitudinal direction.

The fixing device heats and fixes, at a nip (fixing nip), a toner image formed at an image forming portion by an image forming method of a general electrophotographic type. From a left-hand side of (a) of FIG. 5, a recording material P carrying thereon a toner image T is fed by an unshown feeding means and passed through the fixing device, so that the toner image T is heated and fixed on the recording material P.

The fixing device in this embodiment is constituted by a cylindrical flexible fixing film 1 as a rotatable heating member, a film guide 2 for holding the fixing film 1, and a pressing roller 4 as a pressing member for forming the fixing nip (nip) in cooperation with the fixing film 1. The pressing roller 4 is constituted as an opposing member which opposes the fixing film 1 and which forms the nip (fixing nip) between itself and the fixing film 1.

The film guide 2 is formed of a heat-resistant resin material such as a liquid crystal polymer, PPS or PEEK and engages with a fixing stay 5 held by a device frame at longitudinal end portions. A pressing spring (not shown) as a pressing means presses the fixing stay 5 at the longitudinal end portions, so that the film guide 2 is pressed toward the pressing roller 4.

The fixing stay 5 uses a rigid material such as iron, stainless steel, or zinc-coated steel plate, in order to uniformly transmit pressure (pressing force) exerted thereon at longitudinal end portions, and is formed in a U-shape in cross-section, so that the rigidity is enhanced. As a result, in a state in which flexure of the film guide 2 is suppressed, a predetermined-width fixing nip N uniform with respect to the longitudinal direction is formed between the fixing film 1 and the pressing roller 4. Further, the film guide 2 is provided with a temperature detecting element 6, which contacts an inner surface (inner peripheral surface) of the fixing film 1. Depending on a detection temperature of the temperature detecting element 6, energization to the fixing film 1 is controlled by an unshown CPU.

In this embodiment, as a material of the film guide 2, the liquid crystal polymer is used, and as a material of the fixing stay 5, the zinc-coated steel plate is used. The pressure exerted on the pressing roller 4 is 160 N, and at this time, the fixing nip N of about 6 mm is formed.

The pressing roller 4 is constituted by a core metal 4*a* formed of a material such as iron or aluminium, an elastic layer 4*b* formed of a material such as silicone rubber, and a parting layer 4*c* formed of a material such as PFA. A hardness of the pressing roller 4 may preferably be in a range of 40° to 70° under a load of 9.8 N as measured by an ASKER-C hardness meter so as to satisfy a width and a durability of the fixing nip N satisfying a fixing property.

In this embodiment, on the iron core metal of 11 mm in diameter, a 3.5 mm-thick silicone rubber layer is formed, and thereon, a 40 μm-thick insulating PFA tube is coated, so that the pressing roller 4 is 56° in hardness and 18 mm in outer diameter. A longitudinal length of the elastic layer and the layer parting is 240 mm.

The electric power supplying members 3*a* and 3*b* are wired with an AC cable 7 from an AC voltage source 50 ((b) of FIG. 5), and contact outer peripheral surfaces of electroconductive layers 1*b* at longitudinal end portions of the fixing film 1. As the electric power supplying members 3*a* and 3*b*, a brush-shaped or plate-shaped spring or pad formed with thin bundle wire of gold, or the like, may be used. In this embodiment, as the electric power supplying members 3*a* and 3*b*, a plate-shaped spring of a carbon chip and stainless steel is used. Then, by an urging force of the plate-shaped spring, the carbon chip is pressed against an exposed portion of the outer peripheral surface of the electroconductive layer 1*b*, and an AC voltage is applied from the AC voltage source 50 to the electroconductive layer 1*b* through the AC cable 7, so that electric power supply (energization) to heat generating resistors (resistance heating elements) 1*e* of the fixing film 1 is realized.

In this embodiment, at longitudinal end portions of a base layer 1*a* of the fixing film 1, the electroconductive layers 1*b* are provided, and therefore even when the fixing film 1 is rotated, it is possible to always supply electric power to the heat generating resistors 1*e*. Further, a current uniformly flows from the electric power supplying members 3*a* and 3*b* through the electroconductive layers 1*b* in an entirety of a circumferential direction of the heat generating resistors 1*e* (FIG. 1) which are electrically connected with the electroconductive layers 1*b* and which are described later, and therefore all of a plurality of the heat generating resistors having the same volume resistivity generate heat uniformly.

Further, in (a) of FIG. 5, a rotational force is transmitted from an unshown driving mechanism portion to a driving gear of the pressing roller 4, so that the pressing roller 4 is rotationally driven in the clockwise direction at a predetermined speed. With the rotational drive of the pressing roller 4, the rotational force acts on the fixing film 1 by a frictional force between the pressing roller 4 and the fixing film 1 at the fixing nip N. As a result, an inner surface of the fixing film 1 is placed in a rotation state in the counterclockwise direction around the film guide 2 by the rotation of the pressing roller 4 while being closely contacted to and sliding with the film guide 2.

The rotation of the fixing film 1 by the rotation of the pressing roller 4 is made and the energization to the fixing film 1 is made, so that a temperature of the fixing film 1 increases to a predetermined temperature and the fixing film 1 is in a temperature-controlled state by the temperature detecting element 6. Then, the recording material P on which the toner image T in an unfixed state is placed is introduced, so that an image-carrying surface of the recording material P is nipped and fed through the fixing nip N together with the fixing film 1. In this nip-feeding process, the recording material P is heated by the heat of the fixing film 1, so that the unfixed toner image T on the recording material P is heated and pressed and thus is melted and fixed on the recording material P.

The recording material P passed through the fixing nip N is curvature-separated from the surface of the fixing film 1 and is discharged from the fixing device and then is fed by an unshown (sheet) discharging roller pair.

Figure 6:
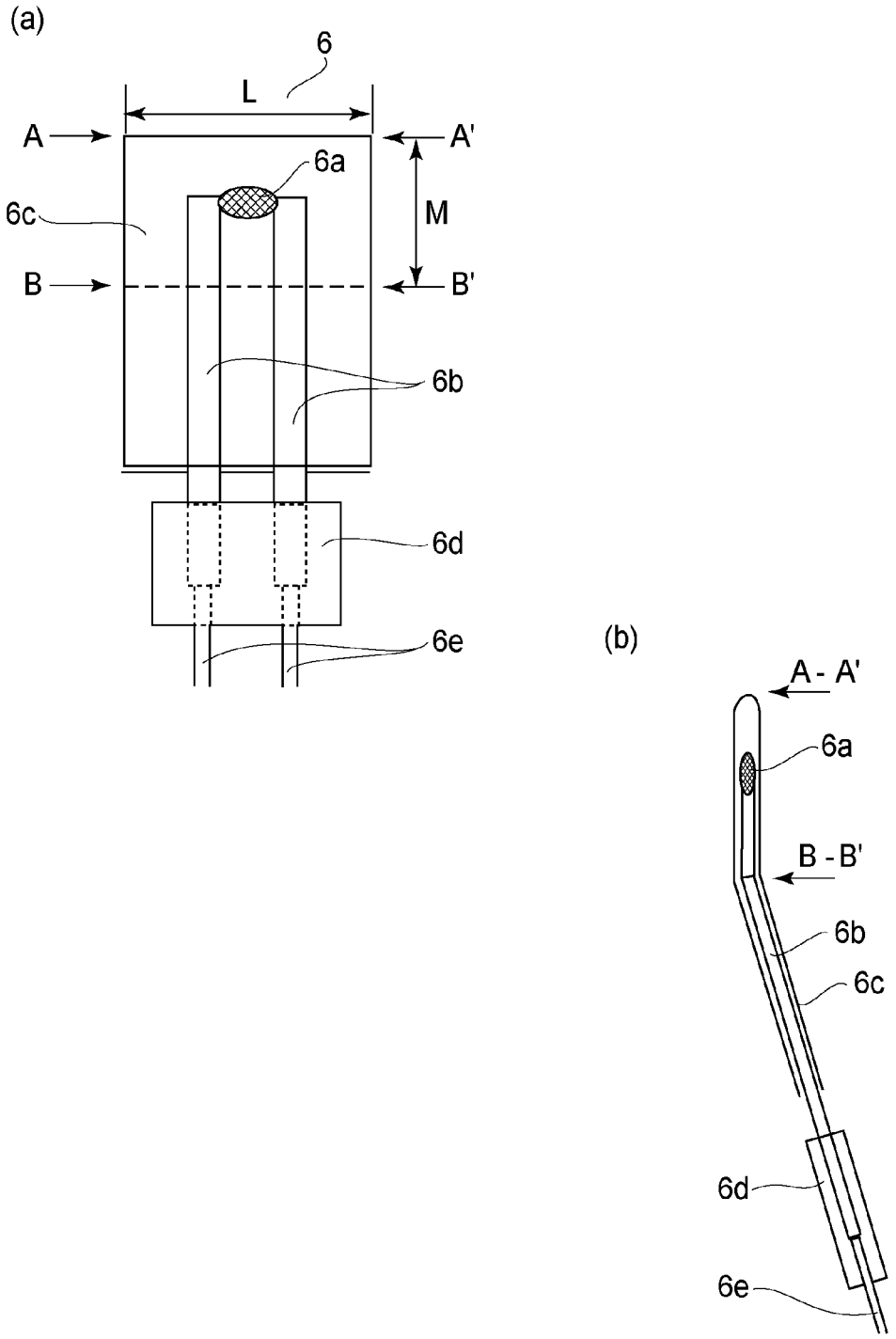
In FIG. 6, (a) is a front view of a temperature detecting element (thermistor) in the First Embodiment, and (b) is a sectional view of the temperature detecting element in the First Embodiment.

In FIG. 6, (a) and (b) show the thermistor 6 which is the temperature detecting element in this embodiment, wherein (a) is a schematic view of the thermistor 6 as seen from a front side, and (b) is a schematic sectional view of the thermistor 6 as seen from a side-surface side. In FIG. 6, a temperature sensor (temperature detecting element, thermistor element) 6*a* is electrically connected with arms 6*b* formed with an electroconductive metal plate. A periphery of the temperature sensor 6*a* including a part of the arms 6*b* is surrounded by an insulating heat-resistant film 6*c*. Further, the arms 6*b* pass through a wiring portion (not shown) in a housing 6*d* formed of a resin material and are electrically connected with lead-out wires (lines) 6*e*.

In this embodiment, as the insulating heat-resistant film 6*c*, an insulating heat-resistant film (e.g., "Kapton (registered trademark) Type 100MT", manufactured by DU PONT-TORAY Co., Ltd.) is used. This film is a 25 μm-thick polyimide sheet excellent in an insulating property and a heat-resistant property, and in this embodiment, an adhesive layer is formed on one surface of the sheet, and two sheets are superposed and used. Specifically, the insulating heat-resistant film 6*c* is folded back in two portions along line A-A' so that the adhesive layer opposes a folded-back adhesive layer portion, and then, the two portions are bonded to each other so as to cover the temperature sensor 6*a* and a part of the arms 6*b*. Thereafter, the film 6*c* is bent together with the arms 6*b* along line B-B'.

The housing 6*d* is fixed to the film guide 2 ((a) of FIG. 5) and is disposed so that the arms 6*b* are projected through cut-away portions provided in the fixing stay 5 ((a) of FIG. 5) and a temperature sensing portion contacts the inner surface of the fixing film 1. Even in a state in which motion of the inner surface of the fixing film 1 becomes unstable, the arms 6*b* swing, whereby the temperature sensing portion is maintained in a state in which the temperature sensing portion always contacts the inner surface of the fixing film 1. In this constitution, a region of the insulating heat-resistant film 6*c* contacting the inner surface of the fixing film 1, in which a longitudinal width is L and a circumferential width is M is a temperature detecting region, and in this embodiment, L=12 mm and M=5 mm.

(Fixing Film)

Figure 1:
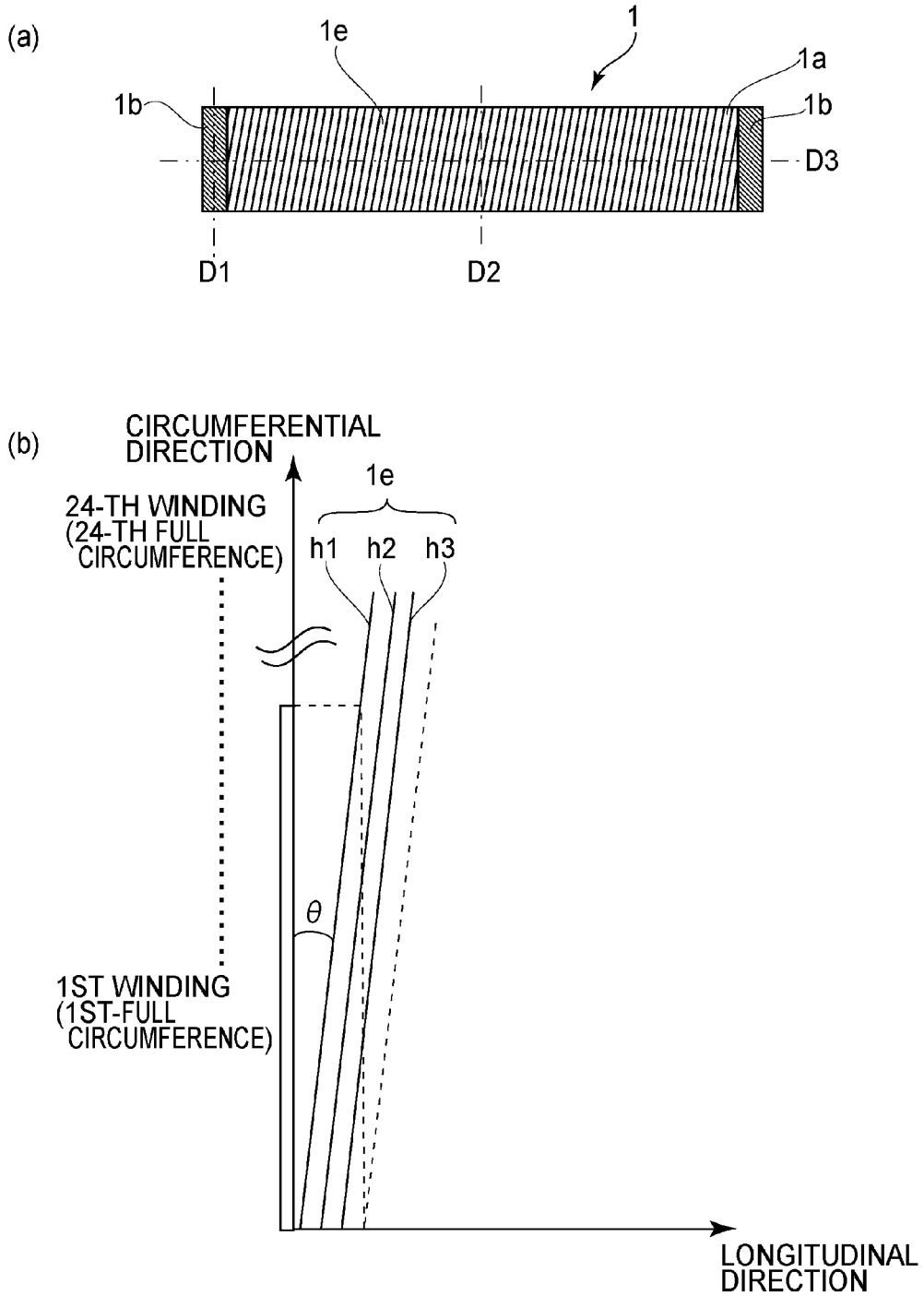
In FIG. 1, (a) is a schematic front view of a fixing film in a First Embodiment, and (b) is a development of heat generating resistors of the fixing film.
Figure 2:
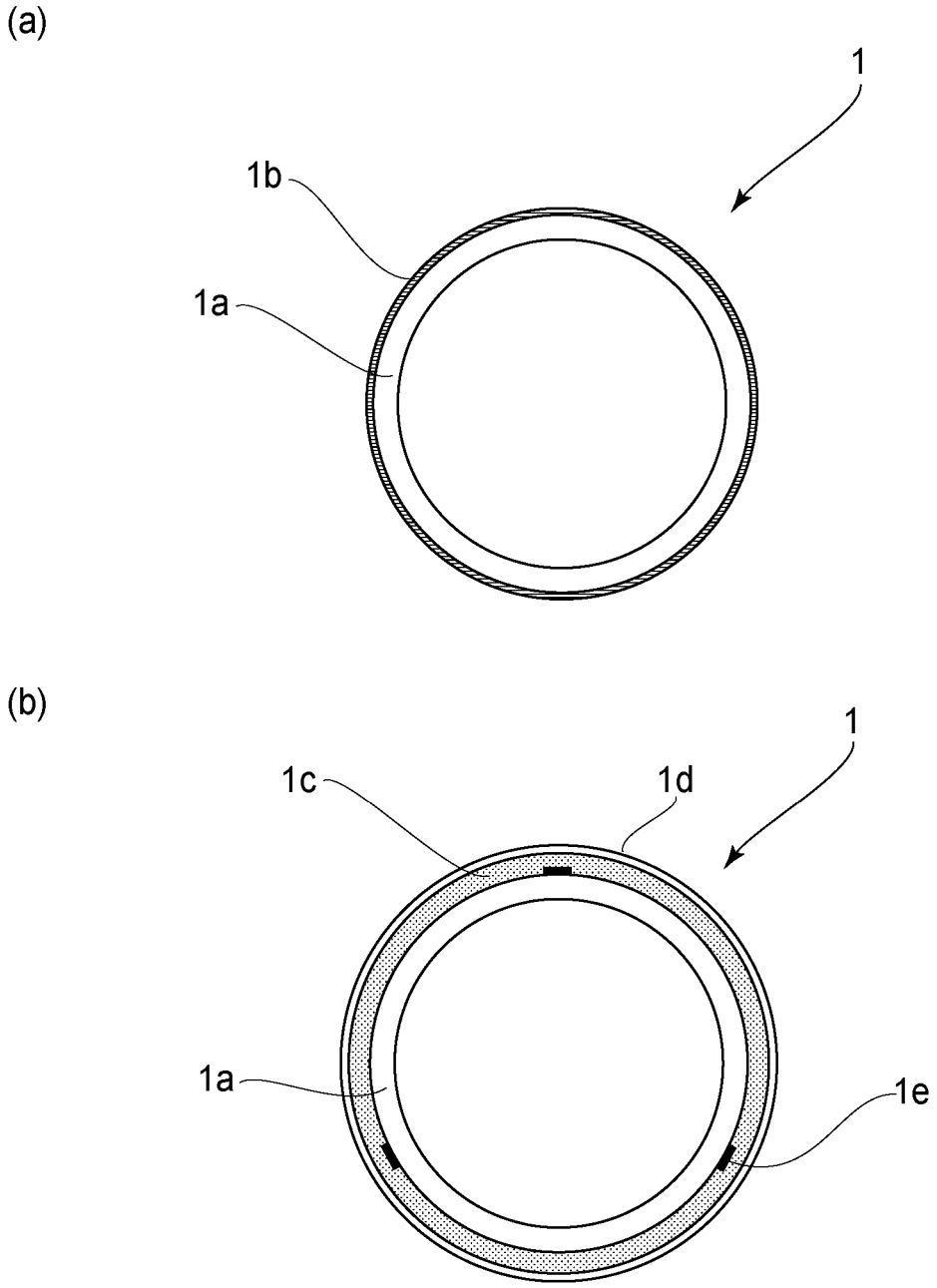
In FIG. 2, (a) and (b) are schematic sectional views of the fixing film in the First Embodiment taken along line D1 and line D2, respectively, of (a) of FIG. 1.
Figure 3:
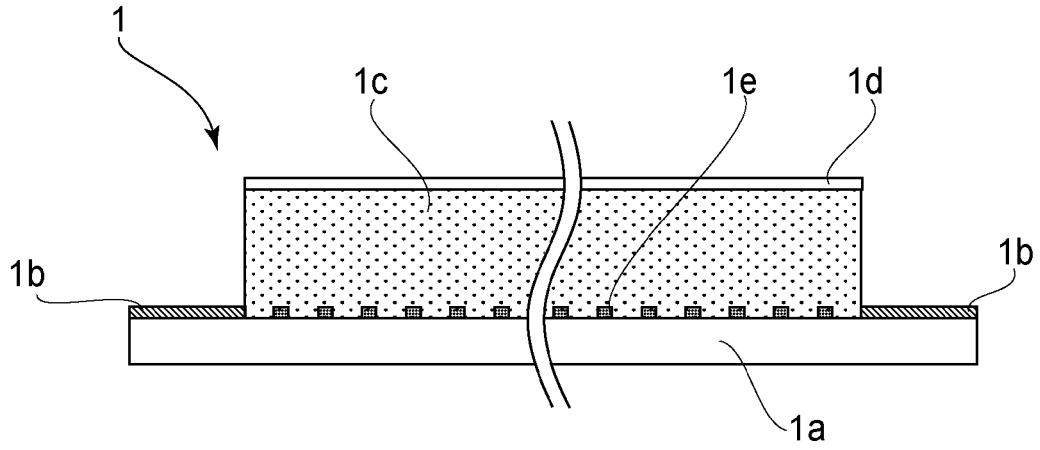
FIG. 3 is a schematic sectional view of the fixing film along a longitudinal direction in the First Embodiment.

A structure of the fixing film 1 in this embodiment will be specifically described using FIGS. 1-3. The fixing film 1 in this embodiment is formed in a helical shape by winding a plurality (three) of heat generating resistors around an insulating or high-resistance cylindrical base layer, so that an electroconductive layer is formed over a circumferential direction at each of the longitudinal end portions of the fixing film 1.

In FIG. 1, (a) is a schematic view for illustrating arrangement of the heat generating resistors 1*e* as seen in a front surface direction (recording material feeding direction), and (b) is a development of the heat generating resistor 1*e* that is helically wound around the cylindrical base layer. As shown in (b) of FIG. 1, three heat generating resistors h1, h2, and h3 (1*e*) are provided with regular intervals (with the same pitch), and extend along the circumferential direction from a first winding (first full circumference) to a 24-TH winding (24-TH full circumference). When each heat generating resistor h1, h2, and h3 (1*e*) is cylindrically wound around the base layer 1*a* by one winding (one full circumference), the position of the heat generating resistor h1, h2, and h3 (1*e*) is in an original (winding start) position with respect to the circumferential direction and is in a position shifted in the longitudinal direction.

That is, in this embodiment, the plurality of heat generating resistors h1, h2, and h3 (1*e*) are provided on the base layer 1*a* so that a helical axis thereof extends along the longitudinal direction of the fixing film 1. Further, the plurality of the heat generating resistors h1, h2, and h3 (1*e*) are disposed with an interval from each other.

In FIG. 2, (a) is a schematic sectional view of the fixing film 1 at a longitudinal end portion taken along line D1 of (a) of FIG. 1, and (b) is a schematic sectional view of the fixing film 1 at a longitudinal central portion taken along line D2 of (a) of FIG. 1. FIG. 3 is a schematic longitudinal sectional view of the fixing film 1 taken along line D3 of (a) of FIG. 1.

In the fixing film 1 in this embodiment, the base layer 1*a* is a base layer having mechanical properties such as torsion strength and smoothness of the fixing film 1 and is formed of a resin material such as polyimide (PI), polyamideimide (PAI) or polyether ether ketone (PEEK). In this embodiment, a polyimide base layer 1*a* of 18 mm outer diameter, 240 mm in longitudinal length and 60 μm in thickness was used.

The base layer 1*a* is insulative and, in order to supply electric power (energy) from an outer surface of the fixing film 1 to the heat generating resistors 1*e*, the electroconductive layers 1*b* for electric power supply (energization) are formed of silver paste on the surface of the base layer 1*a* over an entire region along the circumferential direction at each of longitudinal end portions in a range of 10 mm from an associated longitudinal end of the base layer 1*a*. In this embodiment, as a material of the electroconductive layers 1*b*, silver-paste of $4\times10^{-5}$ Ω·cm in volume resistivity was used. The silver paste is prepared by dispersing silver fine particles into a polyimide resin material in a solvent, and then is applied onto the base layer 1*a*, followed by baking (calcining).

The heat generating resistors 1*e* shown in FIG. 1 are formed on the base layer 1*a*, and longitudinal end portions of each heat generating resistor 1*e* are electrically connected with the electroconductive layers 1*b*. In this embodiment, as the heat generating resistors 1*e*, silver paste of $6\times10^{-5}$ Ω·cm in volume resistivity is formed in a layer by screen printing. In this embodiment, when the electroconductive layers 1*b* provided at one end portion and the other end portion of the base layer 1*a* are a first electroconductive layer and a second electroconductive layer, respectively, one end and the other end of each heat generating resistor 1*e* are electrically connected with the first electroconductive layer and the second electroconductive layer, respectively.

Figure 4:
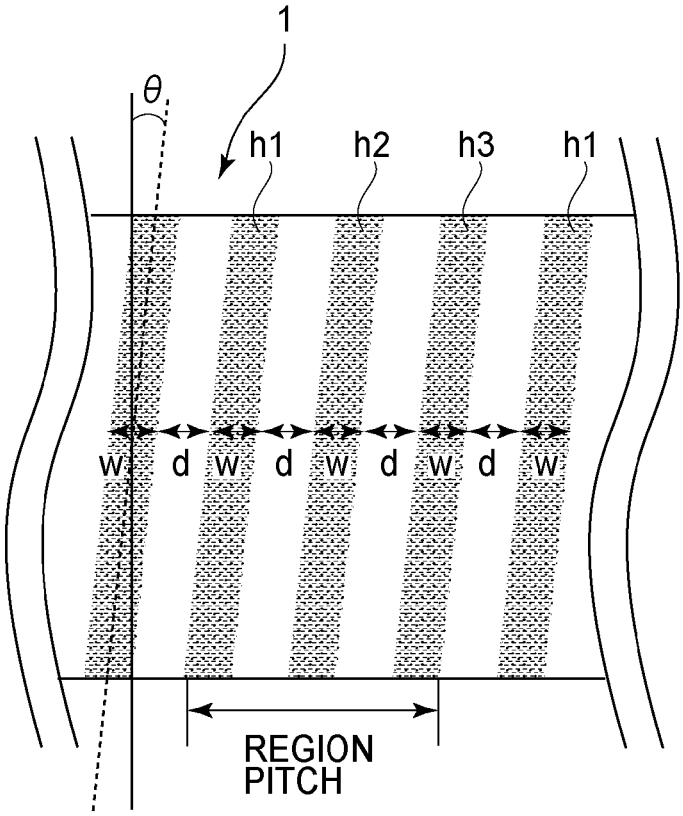
FIG. 4 is an enlarged view of the heat generating resistors in the First Embodiment.

Here, using FIG. 4 which is an enlarged view of the heat generating resistors 1*e* in FIG. 1, the heat generating resistors 1*e* will be described specifically. In FIG. 4, the heat generating resistors 1*e* shown in FIG. 1 are represented by three heat generating resistors h1, h2, and h3 each formed in a helical shape (using the silver paste of $5\times10^{-5}$ Ω·cm in volume resistivity by the screen printing). The three heat generating resistors h1, h2, and h3 each formed in the helical shape have the same linear shape of about 10 μm in thickness, the same volume resistivity, and the same helical shape such that an angle θ with respect to the circumferential direction is 9°, and the heat generating resistor 1*e* is wound 24 times around the base layer 1*a* along the longitudinal direction.

Further, each heat generating resistor 1*e* has a full length of about 1370 mm, a longitudinal width W of 1.5 mm and a longitudinal interval d of 1.5 mm. The heat generating resistors 1*e* have a pitch (W+d) of 3 mm and a heat generating region pitch (3 W+2d) of 7.5 mm. In this state, when the electroconductive layers 1*b* are formed on the base layer 1*a*, a resistance value between both of the electroconductive layers 1*b* with respect to the longitudinal direction is 19.3Ω.

The elastic layer 1*c* shown in FIGS. 2 and 3 is formed of silicone rubber in a thickness of 170 μm in which a thermally conductive filler is dispersed. Further, the parting layer 1*d* is formed in an about 15 μm-thick layer of PFA by subjecting the elastic layer 1*c* to coating with the PFA. The parting layer 1*d* and the elastic layer 1*c* inside the parting layer 1*d* are electrically insulative from each other, and cover a heat generating resistor forming portion of the fixing film 1 along the longitudinal direction, as shown in FIG. 3. On the other hand, at the longitudinal end portions, the elastic layer 1*c* and the parting layer 1*d* are not provided, and the outer peripheral surfaces of the electroconductive layers 1*b* are exposed.

Incidentally, in this embodiment, the electroconductive layers 1*b* and the heat generating resistors 1*e* (h1, h2, h3) were prepared by the screen printing with the silver paste, but may also be formed by another means such as metal plating or sputtering.

Action of this Embodiment

Figure 7:
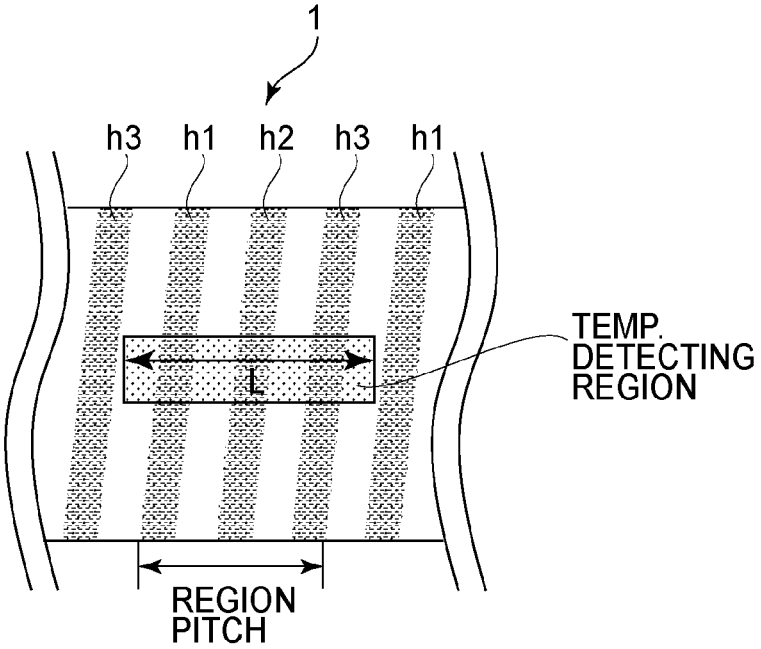
FIG. 7 is a relation view between a temperature detecting region and a heat generating region in the First Embodiment.

FIG. 7 is a schematic view showing a relation between the temperature detecting region of the thermistor 6 and the heat generating region pitch in this embodiment. A temperature detecting region L of the thermistor 6 with respect to the longitudinal direction is 12 mm, and the heat generating region pitch of the heat generating resistors 1*e* with respect to the longitudinal direction is 7.5 mm, so that the temperature detecting region L is larger than the heat generating resistor pitch. That is, the temperature detecting region L of the fixing film 1 by the thermistor 6 overlaps with the plurality of the heat generating resistors 1*e* with respect to the longitudinal direction of the fixing film 1.

Figure 8:
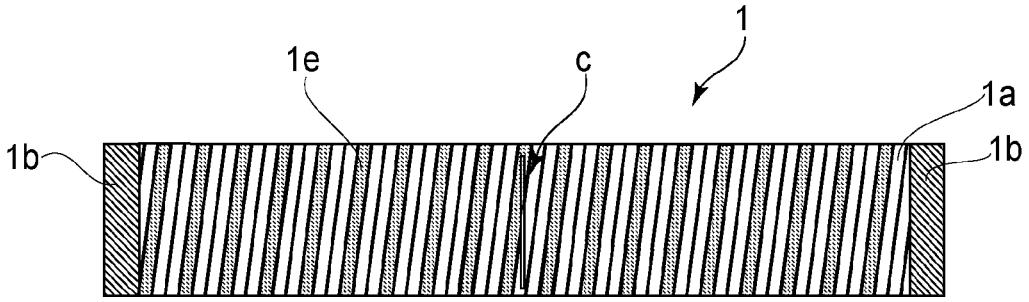
FIG. 8 is a schematic view showing the heat generating region during generation of a crack in the First Embodiment.

Here, the case where the crack C generated in the fixing film 1 will be considered. FIG. 8 is a schematic front view showing a state in which the crack C generated in the fixing film 1 and two of the three heat generating resistors were interrupted (broken). In FIG. 8, a solid gray region is a region where heat is not generated due to breaking the heat generating resistors even when energization is made.

Even in a state in which the crack C generated and, for example, the heat generating resistor h1 and h2 in FIG. 7 are broken and only the heat generating resistor h3 generates heat, the heat generating resistor h3 exists in the temperature detecting region, and therefore temperature rise can be detected even in a rotation stop state. The heat generating resistor h3 is not positioned at the longitudinal central portion in the temperature detecting region, but the heat generation by the heat generating resistor h3 is conducted to the temperature detecting element 6*a* through the insulating heat-resistant film 6*c* of the thermistor 6 contacting the fixing film inner surface.

At this time, a temperature rise speed detected by the thermistor 6 is slower than that during a normal operation (detection), and therefore discrimination that either of the heat generating resistors are broken can be made. Also in the case where only one of the heat generating resistors is broken, similar discrimination can be made. In the case if all of the three heat generating resistors are broken, an entirety of the fixing film region does not generate heat, and therefore, in the case where the detection temperature of the thermistor 6 does not rise even when a predetermined time elapses, discrimination that all of the heat generating resistors are broken can be made.

Figure 9:
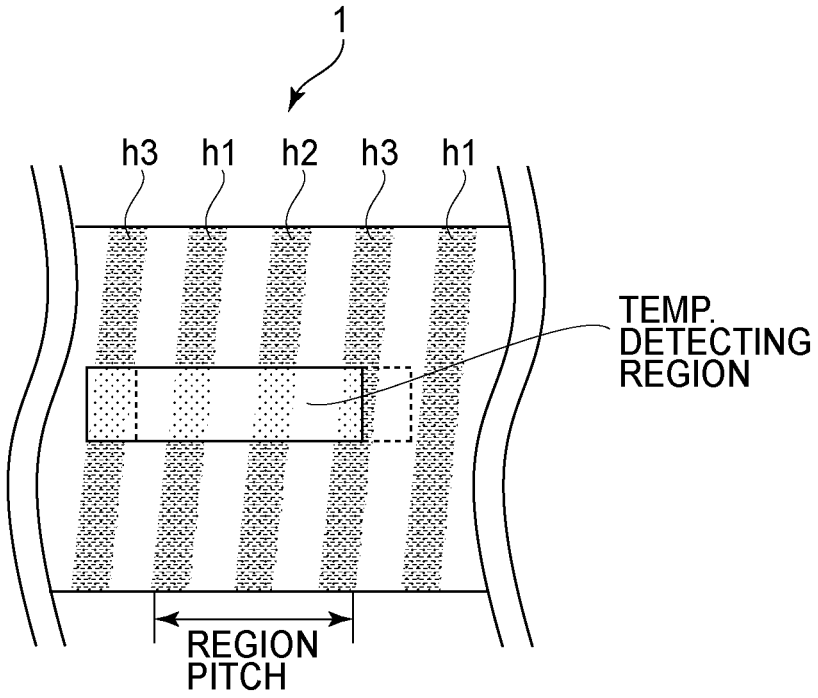
In FIG. 9, (a) and (b) are schematic views each showing the temperature detecting element during generation of shift of the fixing film in the First Embodiment.
Figure 9:
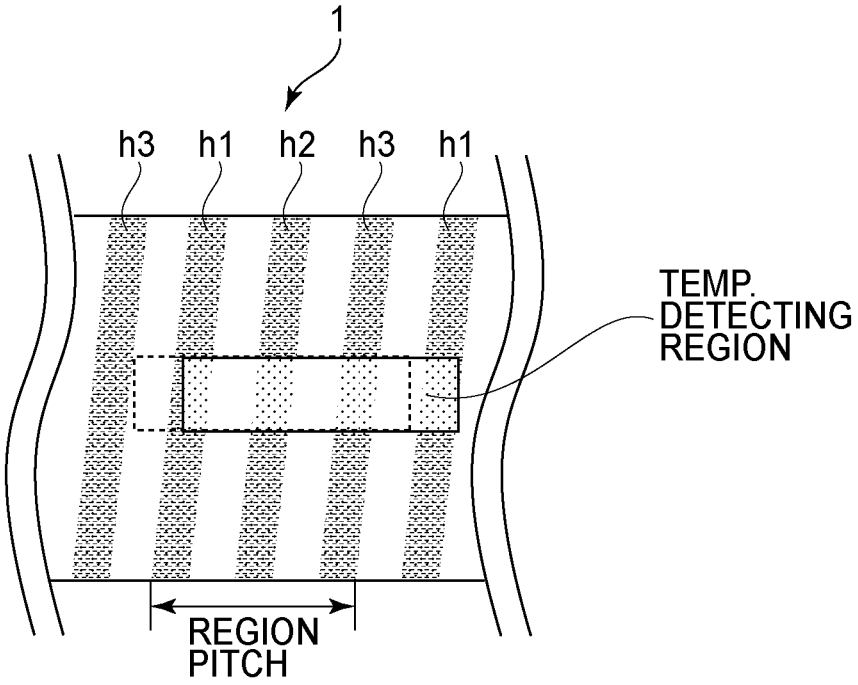

Further, even in the case where the fixing film 1 is shifted leftward or rightward (in the longitudinal direction), the temperature detecting region of the thermistor 6 is broader than the heat generating region and the thermistor 6 is fixed to the film guide 2 which does not move in the fixing device, and therefore all of the heat generating resistors always fall within the temperature detecting region. In FIG. 9, (a) is a schematic view showing a relation between the temperature detecting region of the thermistor 6 and the heat generating region of the heat generating resistors in the case where the fixing film 1 is shifted rightward in the figure, and (b) is a schematic view showing a relation between the temperature detecting region of the thermistor 6 and the heat-resistant region of the heat generating resistors in the case where the fixing film 1 is shifted leftward in the figure.

In FIG. 9, a dotted line represents the temperature detecting region in the case where the fixing film 1 shown in FIG. 1 is in a recording material feeding center position. The fixing film 1 moves by 2 mm at the maximum in one direction (leftward or rightward) in some cases, but even in both of the case where the fixing film 1 is shifted leftward and rightward, the three heat generating resistors h1, h2 and h3 always fall within the temperature detecting region of the thermistor 6. Accordingly, even in a state in which the fixing film 1 is shifted toward one of longitudinal sides and is deviated from the recording material feeding center position, it is possible to detect the temperature rise during the breaking of the heat generating resistor(s).

As described above, according to this embodiment, the plurality of heat generating resistors are helically formed so as to fall within (exist in) the temperature detecting region of the temperature detecting element, whereby even in the case where a part of the plurality of the heat generating resistors break, the temperature detection can be made. Moreover, even in the rotation stop state, abnormal high temperature can be detected. Further, even in the case where the fixing film is shifted in the longitudinal direction, in the rotation stop state, it is possible to detect the temperature of the heat generating resistors in the temperature detecting region.

Second Embodiment

In the following, a Second Embodiment of the present invention will be described using FIGS. 10-15. In this embodiment, as the rotatable heating member, the fixing film 1 was used, but in this embodiment, as the rotatable heating member, a fixing roller is used.

(Fixing Device)

Figure 13:
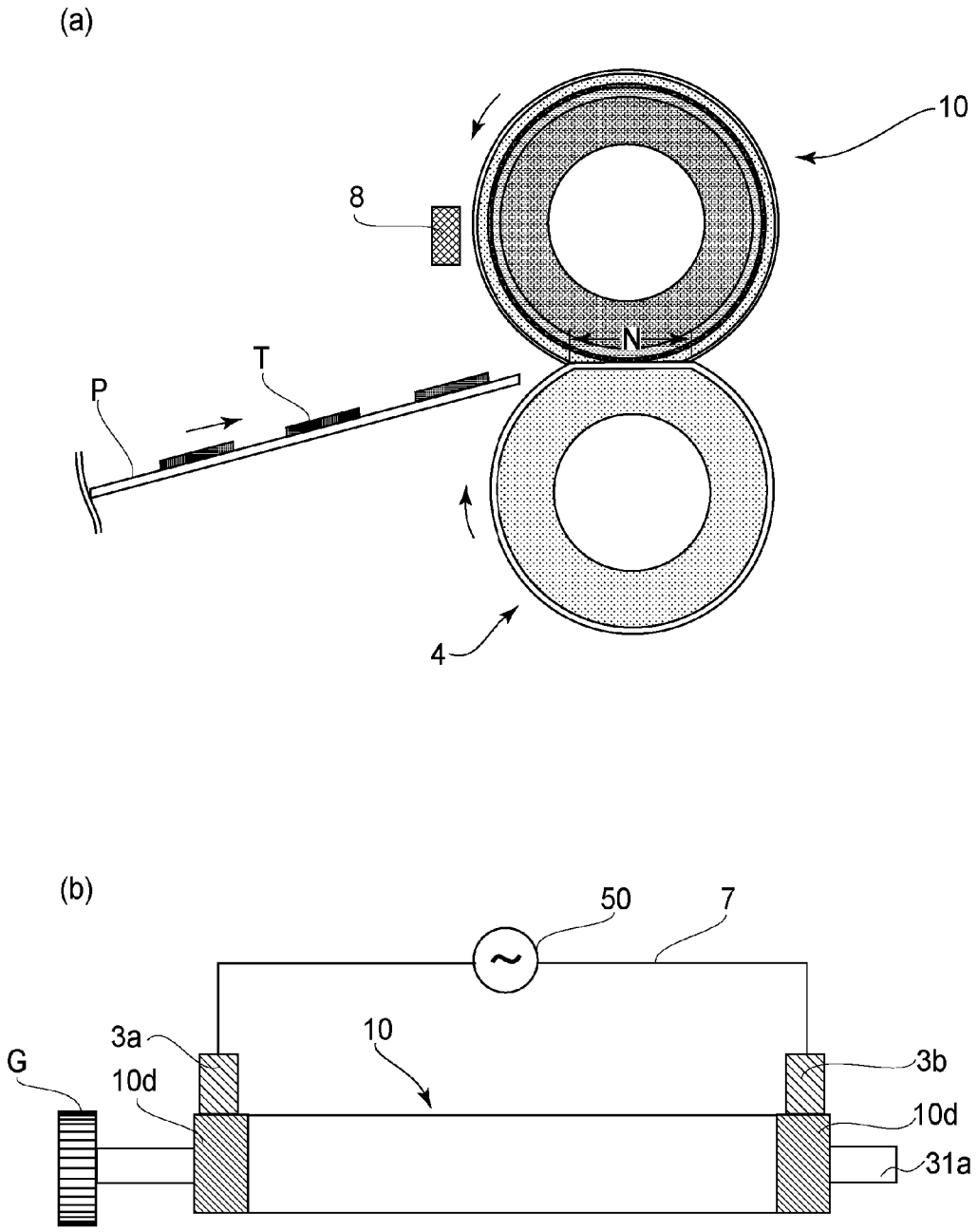
In FIG. 13, (a) is a schematic view of a fixing device in the Second Embodiment, and (b) is a schematic view of the fixing device in the Second Embodiment, as seen in a recording material feeding direction in the Second Embodiment.

In FIG. 13, (a) is a schematic sectional view of a principal part of a fixing device in this embodiment, and (b) is a schematic front view of the fixing device.

The fixing device in this embodiment is constituted by a fixing roller 10 as a rotatable heating member and a pressing roller 4 as a pressing member for forming the fixing nip (nip) N in cooperation with the fixing roller 10.

The fixing roller 10 and the pressing roller 4 are pressed by an unshown pressing means, and a predetermined-width of the fixing nip N is uniform with respect to the longitudinal direction of the pressing roller 4. Further, outside a surface of the fixing roller 10, a non-contact temperature detecting element 8 is provided and detects a temperature of the fixing roller 10. Further, depending on a detection temperature of the temperature detecting element 8, energization to the fixing roller 10 is controlled by an unshown CPU.

The electric power supplying members 3*a* and 3*b* are wired with an AC cable 7 from an AC voltage source 50 ((b) of FIG. 13), and are pressed toward the fixing roller 10 at longitudinal end portions of an opposing portion of the fixing nip N. In this embodiment, as the electric power supplying members 3*a* and 3*b*, a metallized graphite carbon brush was used. An AC voltage is applied from the AC voltage source 50 to this carbon brush through the AC cable 7, so that electric power supply (energization) to heat generating resistors 10*g* (FIG. 10), described later, of the fixing roller 10 is made. Each of the electric power supplying members 3*a* and 3*b* is 6 mm in longitudinal width and 6 mm in width with respect to a feeding direction and is pressed against an associated electroconductive layer 10*d* of the fixing roller 10 with pressure (pressing force) of 4 N.

Further, a rotational force is transmitted from an unshown driving mechanism portion to a driving gear G ((b) of FIG. 13) mounted to the fixing roller 10, so that the fixing roller 10 is rotationally driven in the counterclockwise direction ((a) of FIG. 13) at a predetermined speed. With the rotational drive of the fixing roller 10, the rotational force acts on the pressing roller 4 by a frictional force between the fixing roller 10 and the pressing roller 4 at the fixing nip N. As a result, pressing roller 4 is placed in a rotation state by the rotational drive of the fixing roller 10.

When the energization to the fixing roller 10 is made, a temperature of the fixing film 1 increases to a predetermined temperature and the fixing film 1 is in a temperature-controlled state by the temperature detecting element 8. Then, the recording material P on which the toner image T in an unfixed state is placed is introduced, so that an image-carrying surface of the recording material P is nipped and fed through the fixing nip N together with the fixing roller 10, so that a fixing operation is performed. The recording material P passed through the fixing nip N is curvature-separated from the surface of the fixing roller 10 and is discharged from the fixing device and then is fed by an unshown (sheet) discharging roller pair.

Figure 14:
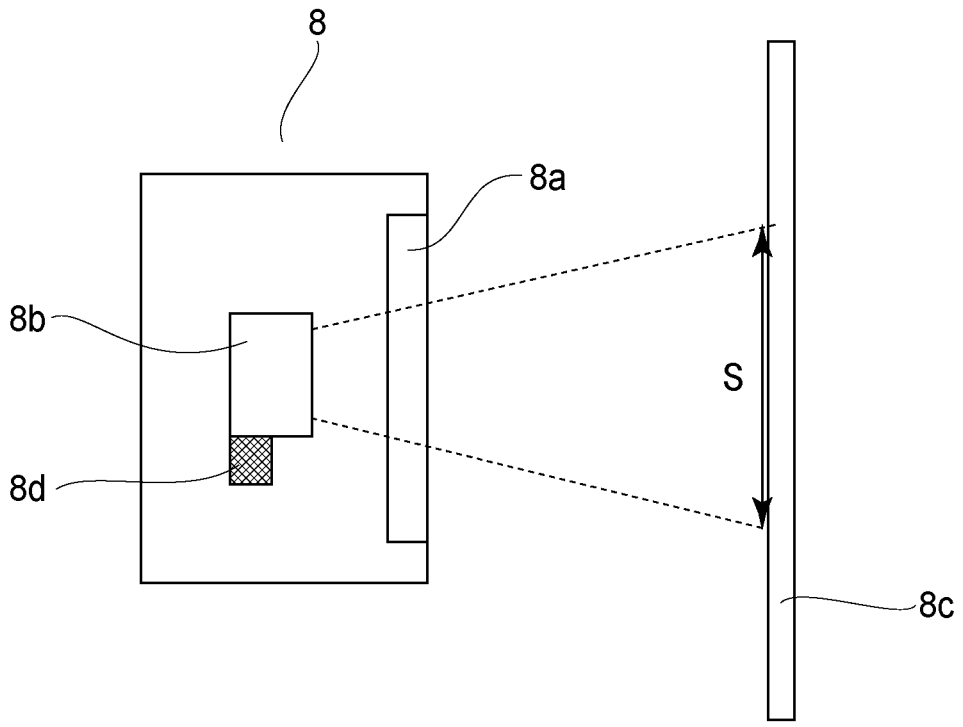
FIG. 14 is a schematic view of a temperature detecting element (thermopile) in the Second Embodiment.

In this embodiment, a non-contact temperature sensor, such as a thermopile, is used as the temperature detecting element 8, which does not damage the fixing roller surface and which is excellent in responsiveness and accuracy. FIG. 14 shows a structure of the thermopile in the case where the thermopile is used as the temperature detecting element 8 in this embodiment.

An operation principle is such that a temperature of an inside heat sensing element is changed by infrared rays passing through a lens 8*a*, which is an infrared transmission window, and thus, an output depending on the temperature is provided. In the case where the thermopile is used as the temperature detecting element 8, the heat sensing element is a laminated thermocouple 8*b*. By radiation of the infrared rays between a member-to-be-measured 8*c* and the laminated thermocouple 8*b*, a temperature of a hot junction of the laminated thermocouple 8*b* is changed, so that a voltage depending on a temperature difference between the hot junction and a cold junction of the laminated thermocouple 8*b* generates. The temperature of the cold junction is measured using another heat sensing element, such as a thermistor 8*d*, and by adding the temperature difference between the cold junction and the hot junction to the temperature of the cold junction, it is possible to obtain a temperature of the member-to-be-measured 8*c*.

The thermopile as the temperature detecting element 8 is fixed to an unshown fixing frame at a longitudinal central portion, and is disposed with a certain gap with the surface of the fixing roller 10. In FIG. 14, dotted lines represent a viewing angle of the thermopile, and a spot having a diameter S represents a temperature detecting region. In this embodiment, the spot diameter S is 20 mm.

(Fixing Roller)

Figure 10:
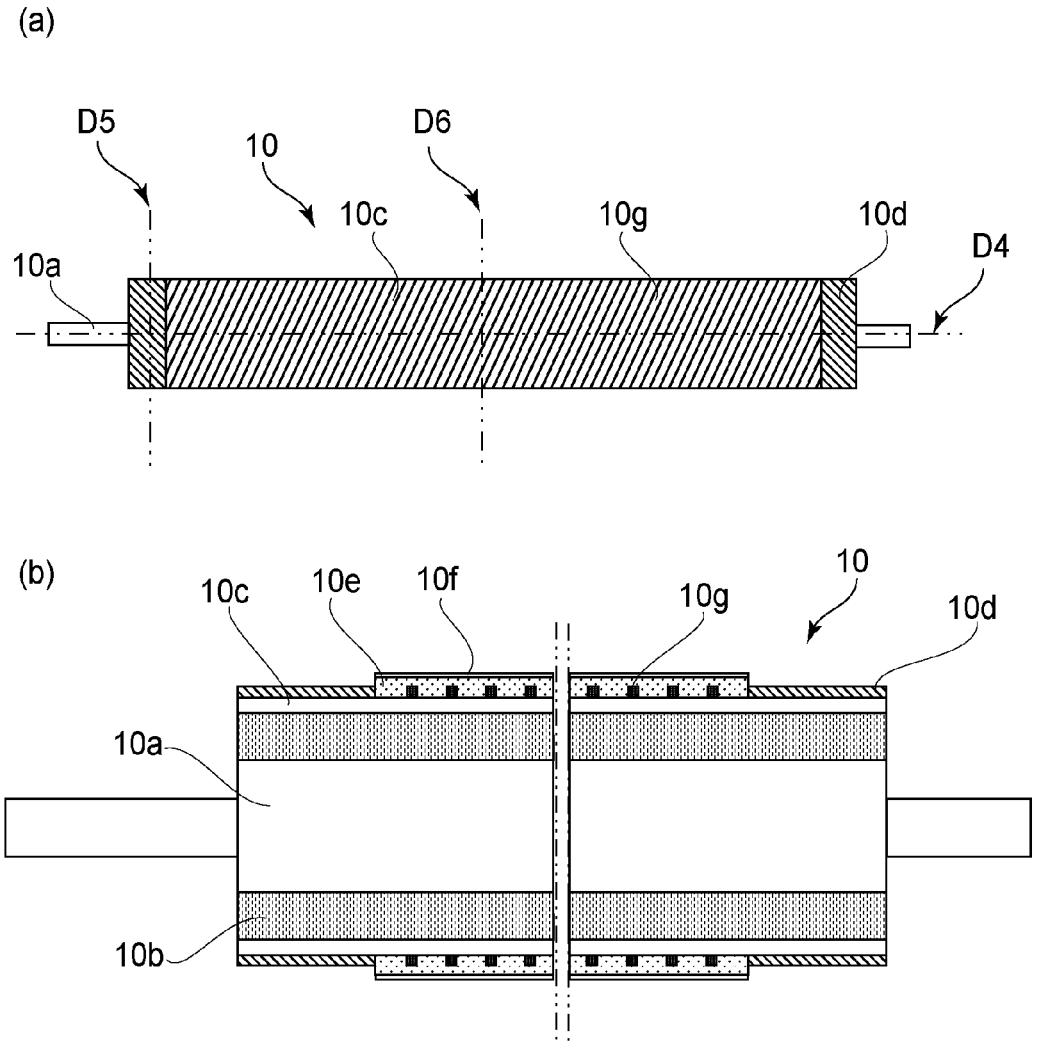
In FIG. 10, (a) is a schematic view of a fixing roller in a Second Embodiment, and (b) is a schematic sectional view of the fixing roller in the Second Embodiment taken along line D4 in (a) of FIG. 10.
Figure 11:
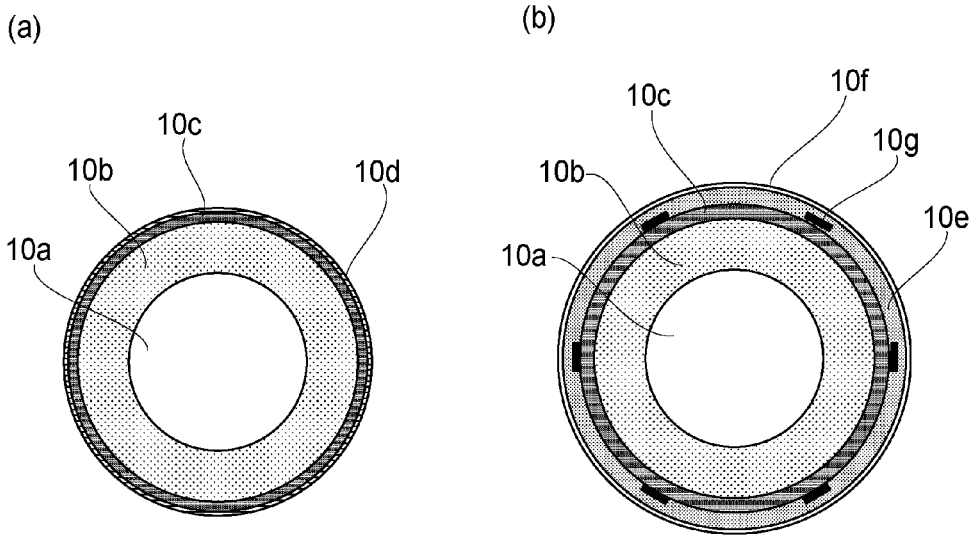
In FIG. 11, (a) and (b) are schematic sectional views of the fixing roller in the Second Embodiment taken along line D5 and line D6, respectively, of (a) of FIG. 10.

In the following the fixing roller 10 will be specifically described. In FIG. 10, (a) is a schematic front view of the fixing roller 10, and (b) is a schematic sectional view of the fixing roller 10 taken along line D4 of (a) of FIG. 10. In FIG. 11, (a) is a schematic sectional view of the fixing roller 10 taken along line D5 of (a) of FIG. 10, and (b) is a schematic sectional view of the fixing roller 10 taken along line D6 of (a) of FIG. 10.

The fixing roller 10 includes a metal core 10*a* which is a rotation shaft, a sponge rubber layer 10*b* formed in a roller shape concentrically integral around the metal core 10*a*, a heat-resistant resin layer 10*c* formed on the rubber layer 10*b*, and electroconductive layers 10*d* for energization formed on an outer surface of the heat-resistant resin layer 10*c* at both end portions each in a region of 10 mm from an associated longitudinal end. On the heat-resistant resin layer 10*c*, heat generating resistors 10*g* are formed and are electrically connected with the electroconductive layers 10*d*, respectively, at longitudinal end portions. Further, in a region other than the longitudinal end portions, on the heat-resistant resin layer 10*c*, a parting layer 10*f* and an elastic layer 10*e* inside the parting layer 10*f* are provided along the longitudinal direction.

Here, the heat-resistant resin layer 10*c* in this embodiment corresponds to the base layer 1*a* in the First Embodiment. Further, in this embodiment, as a base layer, the metal core 10*a* is disposed inside the heat-resistant resin layer 10*c*, and as a rubber layers, the sponge rubber layer 10*b* is disposed inside the heat-resistant resin layer 10*c*.

In this embodiment, the metal core 10*a* formed of stainless steel and having an outer diameter of 11 mm was used, and as the sponge rubber layer 10*b*, an open-cell sponge rubber, in which resin balloons and an open-cell agent are contained in a solid silicone rubber and then the resin balloons are connected with each other by vaporizing the open-cell agent, was used. As the heat-resistant resin layer 10*c*, an insulating polyimide, which is the same as that of the base layer 1*a* used in the fixing film 1 in the First Embodiment, was used. Further, the electroconductive layers 10*d* for energization was formed of the same material as, and in the same thickness as those of the electroconductive layer 1*b* in the First Embodiment.

Also, the elastic layer 10*e* and the parting layer 10*f* are formed of the same material as and in the same thickness as those of the elastic layer 1*c* and the parting layer 1*d*, respectively, in the First Embodiment. In order to effect the energization from end portions of an outer peripheral surface of the fixing roller 10 to the heat generating resistors 10*g*, the elastic layer 10*e* and the parting layer 10*f* are not formed in regions of 10 mm from longitudinal ends of the electroconductive layers 10*d*. These regions where the electroconductive layers 10*d* are exposed are contact regions where the energization is effected by the electric power supplying member.

Figure 12:
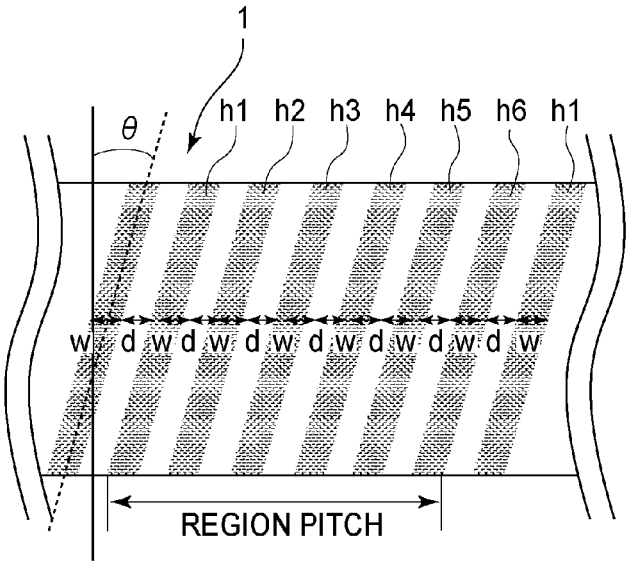
FIG. 12 is an enlarged view of heat generating resistors in the Second Embodiment.

FIG. 12 is an enlarged view of the heat generating resistors 10*g* as seen from a front side of (a) of FIG. 10.

In this embodiment, as the heat generating resistors 10*g*, six heat generating resistors h1-h6, each formed in a helical shape (using the silver paste of $3.5\times10^{-4}$ Ω·cm in volume resistivity by the screen printing) are used. The six heat generating resistors h1-h6, each formed in the helical shape, have the same linear shape of about 10 μm in thickness, the same volume resistivity, and the same helical shape such that an angle θ with respect to the circumferential direction is 21° and the heat generating resistor is wound 10*g* times around the base layer 1*a* along the longitudinal direction.

Further, each heat generating resistor 10*g* has a full length of about 610 mm, a longitudinal width W of 1.8 mm, and a longitudinal interval d of 1.8 mm. The heat generating resistors 10*g* have a pitch (W+d) of 3.6 mm and a heat generating region pitch (6 W+5d) of 19.8 mm. In this state, when the electroconductive layers 10*d* are formed on the heat-resistant resin layer 10*c*, a resistance value between both of the electroconductive layers 10*d* with respect to the longitudinal direction is 20Ω.

An outer diameter of the fixing roller 10 in this embodiment is about 18 mm, and a hardness of the fixing roller 10 may desirably be in a range of 30°-70° as measured by an ASKER-C hardness meter under a load of 5.9 N from viewpoints of ensuring of the fixing nip N and durability of the fixing roller 10. In this embodiment, the hardness of the fixing roller 10 is 52°. Further, similarly as the base layer 1*a* in the First Embodiment, a longitudinal length of the heat-resistant resin layer 10*c* is 240 mm.

Action of this Embodiment

Figure 15:
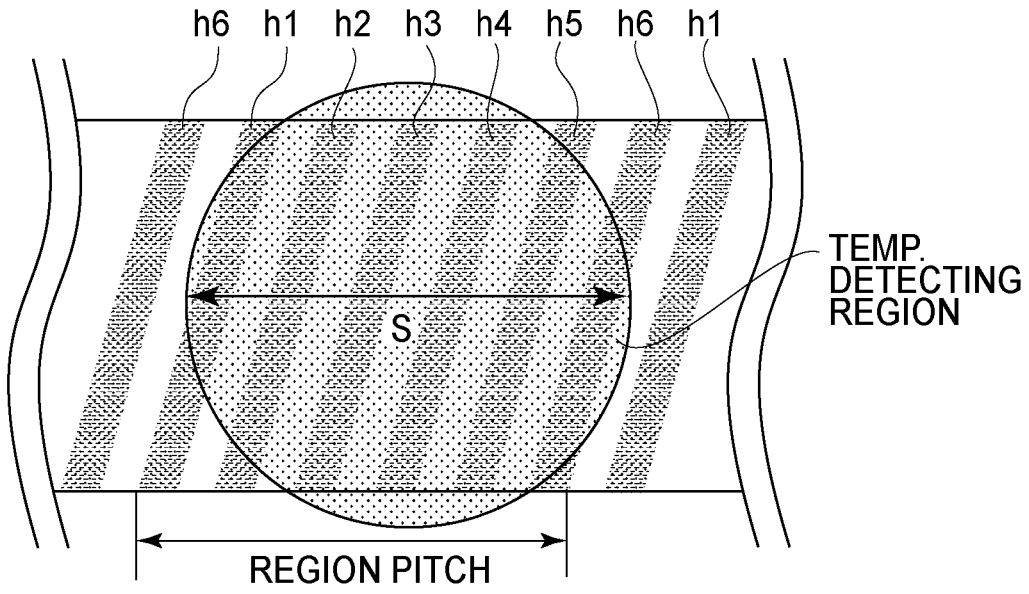
FIG. 15 is a relation view between a temperature detecting region and a heat generating region in the Second Embodiment.

FIG. 15 is a schematic view showing a relation between a temperature detecting region of the thermopile as the temperature detecting element 8 and the heat generating region pitch in this embodiment. A diameter S of the temperature detecting region of the thermopile 8 with respect to the longitudinal direction is 24 mm, and the heat generating region pitch of the heat generating resistors 10*g* is 19.8 mm, so that the diameter S of the temperature detecting region is larger than the heat generating resistor pitch.

Even in a state in which the crack C generated in the fixing roller 10 and, for example, the heat generating resistors h1-h5 are broken, and only the heat generating resistor h6 generates heat, as shown in FIG. 15, the heat generating resistor h6 exists in the temperature detecting region, and therefore, a temperature rise can be detected even in a rotation stop state. At this time, similarly as in the First Embodiment, a temperature rise speed detected by the thermopile (temperature detecting element) 8 is slower than that during a normal state, and therefore, a discrimination that any of the heat generating resistors are broken can be made. Also, in the case where only one of the heat generating resistors is broken, a similar discrimination can be made.

In the case if all of the six heat generating resistors h1-h6 are broken, an entirety of the fixing roller 10 region does not generate heat, and therefore, in the case where the detection temperature of the thermopile (the temperature detection element) 8, does not rise even when a predetermined time elapses, discrimination that all of the heat generating resistors h1-h6 are broken can be made.

Further, even in the case where the fixing roller 10 is shifted leftward or rightward, the temperature detecting region of the thermopile 8 is broader than the heat generating region, and the thermopile 8 is fixed to the fixing frame which does not move in the fixing device, and therefore, all of the heat generating resistors h1-h6 always fall within the temperature detecting region. The fixing roller 10 moves by 2 mm at the maximum in one direction (leftward or rightward) in some cases, but even in both of the case where the fixing roller 10 is shifted leftward and rightward, the six heat generating resistors h1-h6 always fall within the temperature detecting region of the thermopile 8. Accordingly, even in a state in which the fixing roller 10 is shifted toward one of longitudinal sides and is deviated from the recording material feeding center position, it is possible to detect the temperature rise during the breaking of the heat generating resistor(s).

As described above, according to this embodiment, the plurality of heat generating resistors are helically formed so as to exist in the temperature detecting region of the temperature detecting element, whereby even in the case where a part of the plurality of the heat generating resistors caused breaking, the temperature detection can be made. Moreover, even in the rotation stop state, abnormal high temperature can be detected. Further, even in the case where the fixing roller is shifted in the longitudinal direction, in the rotation stop state, it is possible to detect the temperature of the heat generating resistors in the temperature detecting region.

Incidentally, in this embodiment, the pressing roller 4 was used as the pressing member, but as the pressing member, for example, a fixing film unit using a follower fixing film may also be used.

Third Embodiment

In this embodiment, compared to the fixing device of the First Embodiment, the number of heat generating resistors formed in the helical shape on the fixing film is increased to six as in the Second Embodiment, and as the temperature detecting element, two thermistors are spaced in the longitudinal direction. Other constitutions are similar to those in the First Embodiment, and therefore will be omitted from description.

In a constitution including the plurality of heat generating resistors, in the case where the resistance between the electroconductive layers at the longitudinal end portions is the same, an amount of a current per (one) heat generating resistor can be decreased with an increasing number of the heat generating resistors. For this reason, an abnormal heat generation suppressing effect in the case where a crack such that the heat generating resistors are partly broken generated becomes large. That is, an abnormal heat generation amount is smaller in this embodiment in which the six heat generating resistors are formed than in the case of the fixing film in the First Embodiment in which the heat generating resistors are formed.

Here, as in the Second Embodiment, in the case in which a constitution having six heat generating resistors is intended to be used, the longitudinal heat generating region pitch is 19.8 mm, so that all of the heat generating resistors cannot be placed in the longitudinal temperature detecting region 12 mm of the thermistor, contacting the inner surface of the fixing film, as used in the First Embodiment. Therefore, in this embodiment, a constitution in which the thermistor used in the First Embodiment is disposed at two positions, so that two thermistors are spaced from each other in the longitudinal direction and each thermistor detects the thermistors of three of the six heat generating resistors was employed.

Figure 16:
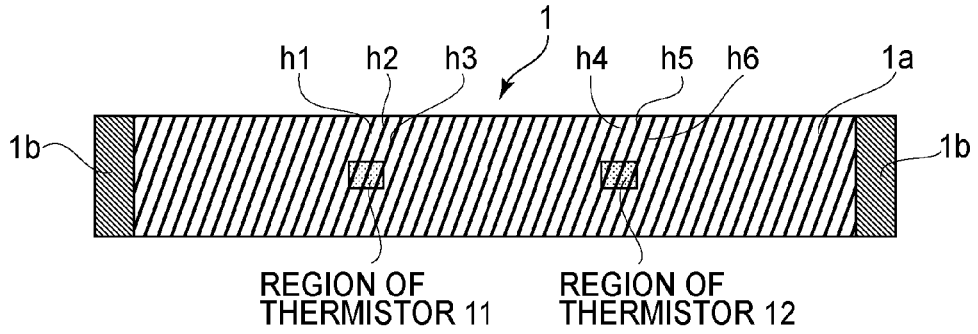
FIG. 16 is a relation view between a temperature detecting region and a heat generating region in a Third Embodiment.

FIG. 16 shows an arrangement of heat generating resistors h1-h6 as seen in a front surface direction of the fixing film 1 in this embodiment, and temperature detecting regions of two thermistors 11 and 12. The heat generating resistors h1-h6 are disposed so that the heat generating regions of the heat generating resistors h1, h2, and h3 fall within the temperature detecting region of the thermistor 11, and the heat generating regions of the heat generating resistors h4, h5, and h6 fall within the temperature detecting region of the thermistor 12.

The heat generating region pitch of the heat generating resistors h1, h2, and h3 is 9 mm, and the longitudinal temperature detecting region of the thermistor 11 is 12 mm. Similarly, the heat generating region pitch of the heat generating resistors h4, h5, and h6 is 9 mm, and the longitudinal temperature detecting region of the thermistor 12 is 12 mm. Even in the case where the fixing film 1 is shifted, positions of and an interval between the two thermistors 11 and 12 are unchanged, and therefore, all of the heat generating resistors h1-h6 exist in one of the temperature detecting regions of the thermistors 11 and 12.

Figure 17:
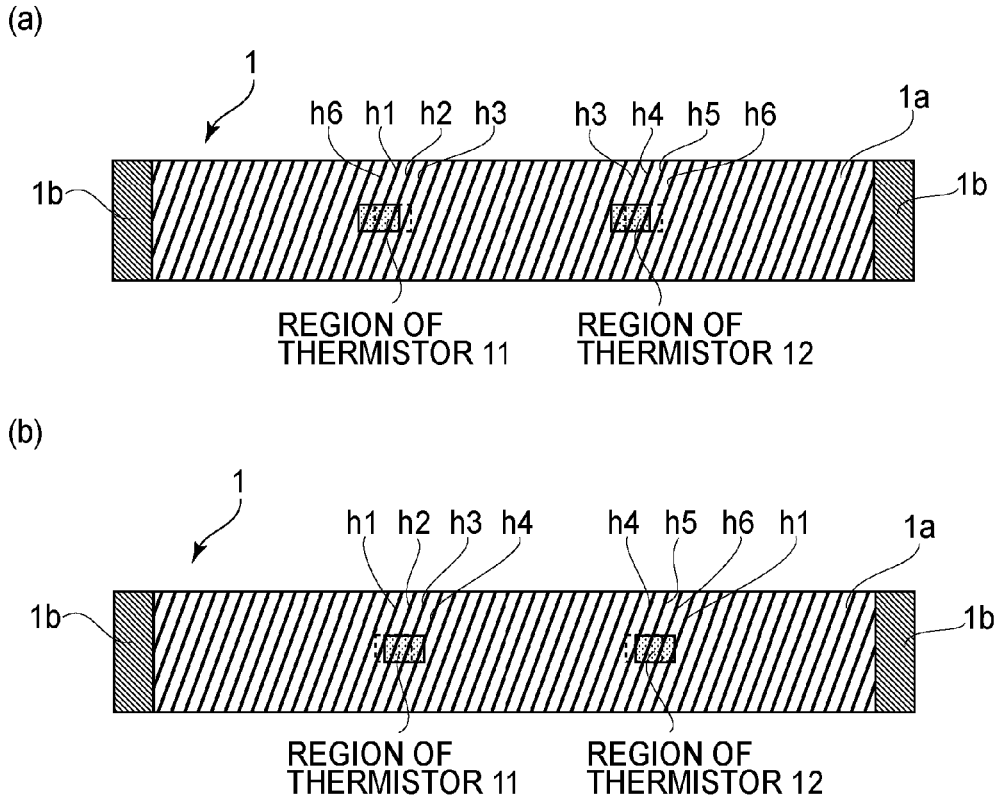
In FIG. 17, (a) and (b) are schematic views each showing the temperature detecting region during generation of shift of a fixing film in the Third Embodiment.
Figure 18:
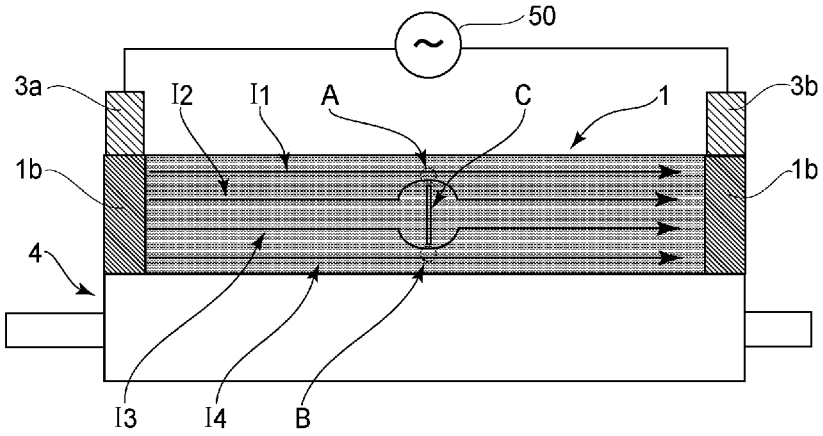
FIG.18 Prior Art
FIG. 18 is a schematic view of a conventional fixing device using a rotatable heating member including a heat generating resistor layer.
Figure 19:
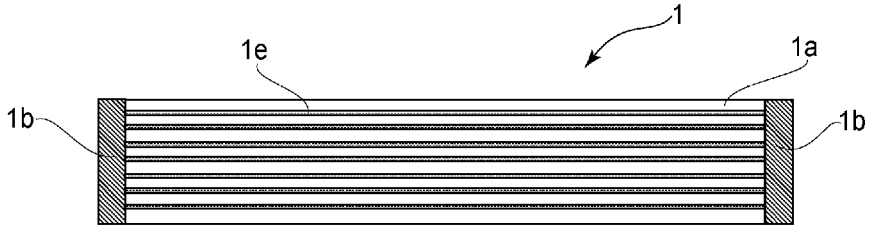
FIG.19 Prior Art
FIG. 19 is a schematic view of a conventional fixing film including a plurality of heat generating resistors.
Figure 20:
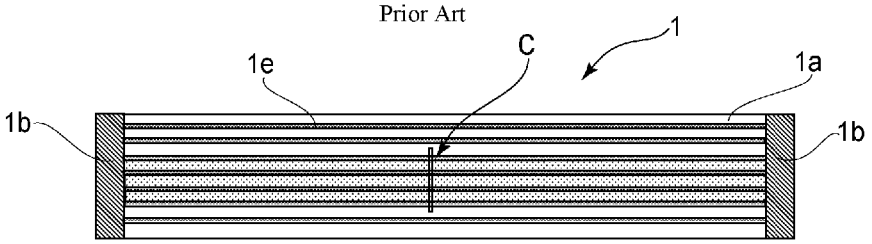
FIG.20 Prior Art
FIG. 20 is a schematic view showing a heat generation distribution of the conventional fixing film including the plurality of heat generating resistors during generation of a crack.

In FIG. 17, (a) shows the case where the fixing film 1 is shifted rightward by one heat generating resistor in the figure (solid line), and (b) shows the case where the fixing film 1 is shifted leftward by one heat generating resistor in the figure (solid line). In FIG. 17, dotted lines show temperature detecting regions in the case where the fixing film 1 is in a center position.

In (a) of FIG. 17, temperatures of the heat generating resistors h6, h1 and h2 are detected by the thermistor 11, and temperatures of the heat generating resistors h3, h4 and h5 are detected by the thermistor 12. In (b) of FIG. 17, temperatures of the heat generating resistors h2, h3 and h4 are detected by the thermistor 11, and temperatures of the heat generating resistors h5, h6 and h1 are detected by the thermistor 12. That is, in either case, all of the heat generating resistors exist in either of the temperature detecting regions of the thermistors 11 and 12.

Incidentally, in this embodiment, the case where the two thermistors are spaced from each other in the longitudinal direction was described, but three or more thermistors may also be spaced from each other in the longitudinal direction. Further, when a plurality of thermopiles are used, the temperature detecting region can be set as a broad temperature detecting region, and therefore, even when the number of the heat generating resistors is further increased, it is possible to detect temperatures of all of the heat generating resistors.

As described above, in this embodiment, by using the plurality of temperature detecting elements, it is possible to form the heat generating resistors in a large number. As a result, the current amount per (one) heat generating resistor can be decreased, so that, in the case in which the crack generated, the abnormal heat generation suppressing effect is increased. Further, even in the case where the fixing film is shifted, in a rotation step state, it is possible to detect the temperatures of all of the heat generating resistors.

MODIFIED EMBODIMENTS

In the above-described embodiments, preferred embodiments of the present invention were described, but the present invention is not limited thereto. Within the scope of the present invention, various modifications can be made.

Modified Embodiment 1

In the above-described embodiments, the plurality of heat generating resistors provided helically are disposed at the same intervals (with the same pitch) along the longitudinal direction, but may also be disposed at different intervals (with different pitches). The heat generating resistors may only be required to be provided so that a plurality of heat generating resistors fall within the temperature detecting region of the temperature detecting element. The number of the plurality of heat generating resistors may preferably be three or more, but may also be two.

Modified Embodiment 2

In the above-described embodiments, the base layer was insulative, but a constitution in which the base layer is formed as a high-resistance layer and thus the heat generating resistors and the electroconductive layers are made smaller in volume resistivity than the base layer may also be employed.

Modified Embodiment 3

In the above-described First and Third Embodiments, the temperature detecting region extends in the longitudinal direction, but the temperature detecting region may also extend in any direction crossing the longitudinal direction. Further, in the Third Embodiment, a constitution in which a plurality of temperature detecting elements are provided so as to be spaced from each other in any direction and in which each of the heat generating resistors falls within (exists in) either one of the temperature detecting regions of the temperature detecting elements may only be required to be employed.

Modified Embodiment 4

In the above-described embodiments, the fixing device for fixing the unfixed toner image on the sheet was described as an example, but the present invention is not limited thereto. The present invention is also similarly applicable to a device for heating and pressing the toner image temporarily fixed on the sheet in order to improve glossiness of the image (the device is also referred to as the fixing device).

Modified Embodiment 5

In the above-described embodiments, the recording paper was described as the recording material, but the recording material in the present invention is not limited to the paper. In general, the recording material is a sheet-shaped member on which the toner image is formed by the image forming apparatus, and may include, e.g., regular or irregular sheet-shaped members such as plain paper, thick paper, thin paper, envelope, postcard, seal, resin sheet, OHP sheet and glossy paper. Incidentally, in the above-described embodiments, for convenience, treatment of the recording material (sheet) P was described using terms such as sheet (paper) passing, sheet discharge, sheet feeding, the sheet passing portion, the non-sheet-passing portion, but the recording material in the present invention is not limited to the paper by the description.

Modified Embodiment 6

In the above-described embodiments, as the pressing member, the rotatable region member rotating together with the rotatable fixing member was described, but the present invention is not limited thereto. The present invention is applicable to a flat-shaped pressing pad fixed as the pressing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-171833 filed on Sep. 1, 2015, which is hereby incorporated by reference herein in its entirety.

What is claimed is:

1. A fixing device for fixing an image on a recording material, said fixing device comprising:

a rotatable heating member for heating the image, said rotatable heating member including:

a base layer, first and second electroconductive layers provided at end portions, respectively, of said base layer with respect to a longitudinal direction of said rotatable heating member, and a plurality of heat generating resistors provided on said base layer and having a volume resistivity smaller than a volume resistivity of said base layer;

a temperature detecting member for detecting a temperature of said rotatable heating member; and an electrode member, contacting said first electroconductive layer and said second electroconductive layer, for supplying electric power to said plurality of heat generating resistors, wherein each of said plurality of heat generating resistors is provided helically around said base layer so that a helical axis of each of said plurality of heat generating resistors extends along the longitudinal direction of said rotatable member, and said plurality of heat generating resistors is disposed with intervals, wherein each of said plurality of heat generating resistors has one end of each of said heat generating resistors are electrically connected with said first electroconductive layer, and another end electrically connected with said second electroconductive layer, and wherein a temperature detecting region of said rotatable heating member, in which said temperature detecting member detects the temperature of said rotatable heating member, overlaps with each of said plurality of heat generating resistors.

2. The fixing device according to claim 1, wherein said plurality of heat generating resistors includes three or more heat generating resistors.

3. The fixing device according to claim 1, wherein said rotatable heating member further comprises a parting layer for covering said plurality of heat generating resistors, wherein said parting layer is provided so that at least a part of said first electroconductive layer and a part of said second electroconductive layer are exposed to an outside of said rotatable member.

4. The fixing device according to claim 1, wherein said rotatable member is a film.

5. The fixing device according to claim 4, wherein said temperature detecting member contacts an inner surface of said film.

6. The fixing device according to claim 1, wherein said rotatable member is a roller.

7. The fixing device according to claim 1, wherein said temperature detecting member externally detects a temperature of said rotatable member and does not contact said rotatable member.

8. A fixing device for fixing an image on a recording material, said fixing device comprising:

a rotatable heating member for heating the image, said rotatable heating member including:

a base layer, first and second electroconductive layers provided at end portions, respectively, of said base layer with respect to a longitudinal direction of said rotatable heating member, and a plurality of heat generating resistors provided on said base layer and having a volume resistivity smaller than a volume resistivity of said base layer;

a plurality of temperature detecting members for detecting a temperature of said rotatable heating member; and an electrode member, contacting said first electroconductive layer and said second electroconductive layer, for supplying electric power to said plurality of heat generating resistors, wherein each of said plurality of heat generating resistors is provided helically around said base layer so that a helical axis of each of said plurality of heat generating resistors extends along the longitudinal direction of said rotatable member, and said plurality of heat generating resistors is disposed with intervals, wherein each of said plurality of heat generating resistors has one end electrically connected with said first electroconductive layer, and another end electrically connected to said second electroconductive layer, and wherein a total temperature detecting region of said rotatable heating member, in which said plurality of temperature detecting members detect the temperature of said rotatable heating member, overlaps with each of said plurality of heat generating resistors.

9. The fixing device according to claim 8, wherein said plurality of temperature detecting members includes a first temperature detecting member and a second temperature detecting member, and wherein a temperature detecting region of said rotatable heating member by said first temperature detecting member is different from a temperature detecting region of said rotatable member by said second temperature detecting member in the longitudinal direction of said rotatable heating member.

* * * * *